US007686361B1

(12) United States Patent
Flinn

(10) Patent No.: US 7,686,361 B1
(45) Date of Patent: Mar. 30, 2010

(54) ANIMAL WASTE HANDLING DEVICE

(76) Inventor: Douglas G. Flinn, 118 East Ave., Naples, FL (US) 34108

( * ) Notice: Subject to any disclaimer, the term of this patent is extended or adjusted under 35 U.S.C. 154(b) by 0 days.

(21) Appl. No.: 12/288,426

(22) Filed: Oct. 21, 2008

(51) Int. Cl.
*A01K 29/00* (2006.01)

(52) U.S. Cl. ..... 294/1.4; 294/19.1

(58) Field of Classification Search ..... 294/1.3–1.5, 294/19.1
See application file for complete search history.

(56) References Cited

U.S. PATENT DOCUMENTS 2,616,741 A * 11/1952 Ziese ..... 294/19.1
4,236,741 A * 12/1980 Emme ..... 294/1.5
4,477,111 A * 10/1984 Crooks ..... 294/1.4
4,669,769 A * 6/1987 Polder, Jr. ..... 294/19.1
4,958,871 A * 9/1990 Hemans ..... 294/1.4
5,503,442 A * 4/1996 Lee ..... 294/1.4
6,062,619 A * 5/2000 Clark, Jr. ..... 294/54.5
6,257,634 B1 * 7/2001 Wei ..... 294/19.1
6,520,556 B1 * 2/2003 Hsu ..... 294/19.1
D473,763 S * 4/2003 Jones ..... D8/4
7,004,520 B2 * 2/2006 Khubani et al. ..... 294/19.1

* cited by examiner

*Primary Examiner*—Paul T Chin
(74) *Attorney, Agent, or Firm*—Gold & Rizvi, P.A.; Glenn E. Gold; H. John Rizvi

(57) ABSTRACT

An animal waste handling device includes an elongated foldable. A hand hold thereon has a trigger that operates against a spring bias. A clamp including an upper and a lower clamp element is provided on the handle. A sliding housing is provided on the handle adjacent to the clamp elements and the clamp elements are pivotally attached to the sliding housing. The sliding housing is moved against a spring bias. When the trigger in the hand hold is operated, a cable attached to the trigger moves the sliding housing against the spring bias and opens or closes the clamp elements. A bag for the animal droppings is attached to each of the clamp elements such that the animal waste may be scraped from the ground and contained in the bag, which may then be disposed of in a sanitary manner.

19 Claims, 4 Drawing Sheets

ANIMAL WASTE HANDLING DEVICE

BACKGROUND OF THE INVENTION

The invention pertains to an animal waste handling device that can be used in an easy procedure and in a completely sanitary manner. Pet owners and other observers are quite familiar with city and other municipalities having ordinances that require pet owners, who take their pets for a walk, to pick up the pet's and the animal's droppings such as feces to keep the environment in a sanitary condition. This ordinance, including common sense, applies to public properties as well as private properties. With the increased public concern over sanitation and a cleaner environment many municipalities have required dog owners to clean up after their animals have defecated on public as well as private properties. Although this is most pleasant for the public, it leaves the dog owners with an extremely unpleasant task. Many scooping devices have been provided to keep a bag open while the feces are scraped or scooped therein. Various devices are known to accomplish the above noted mandate. It is known to use plastic gloves that are worn on the hand which simply are used to manually pick up the droppings and by inverting the glove or by stripping the glove off the hand to invert the same, the droppings can be disposed of in a sanitary manner. Others simply carry a small shovel and or a bucket or a similar container to accomplish the same task as noted above. Then there are more complicated devices which accomplish the pick up and disposal of animal droppings in a completely sanitary manner.

U.S. Pat. No. 4,097,082 describes a device which accomplishes the above noted task. The implement described in this patent consists of an electrometric band to automatically close over the mouth of a flexible wrapper which is operated by two side plates that will swing inwardly at their bottoms to thereby grab the flexible wrapper having the animal dropping contained therein and to thereafter dispose the same, all in a sanitary manner.

U.S. Pat. No. 5,628,537 shows a similar device. This patent discloses a device which also uses a pair of jaws that are pivotally attached at one end of a long handle. An elongated sleeve is connected to the jaws around the handle. When the jaws are locked in an open state, a bag clip engages the closed end of an ordinary thin plastic bag, while the open end of the bag is inverted over the edges of the jaws. To pick up the dog feces, the user positions the open bag over the waste, makes the jaws contact the ground, rotates the sleeve to unlock a sliding motion and moves the sleeve downward on the handle. This closes the jaws and encloses the waste within the bag to be disposed of at a later time and in a sanitary manner.

U.S. Pat. No. 6,305,322 discloses a waste pickup device consisting of an elongated tubular handle having an interior manipulator therein. At the end is a tubular casing. The interior handle can manipulate claws that can be retracted into the tubular casing. The claw consists of four claw elements that can receive a paper medium therein. The claw elements will pick up the feces and together with the paper is retracted to within the casing to thereby pick up the waste.

BRIEF DESCRIPTION OF THE INVENTION

The invention consists of an elongated handle that can be reduced in length by folding one half of the handle over the other handle half when not in use. At a forward end of the handle there is located a claw consisting of two claw elements. The claw elements can be activated from the other end of the handle by way of a trigger that tensions a cable which tension is transferred to the jaw elements to open or close the same. In an open state, the two claw elements receive a paper bag that is fastened to each of the claw elements. A compression spring assures that the claw elements remain in a closed state when not in use.

DETAILED DESCRIPTION OF THE INVENTION

Figures 1, 2:
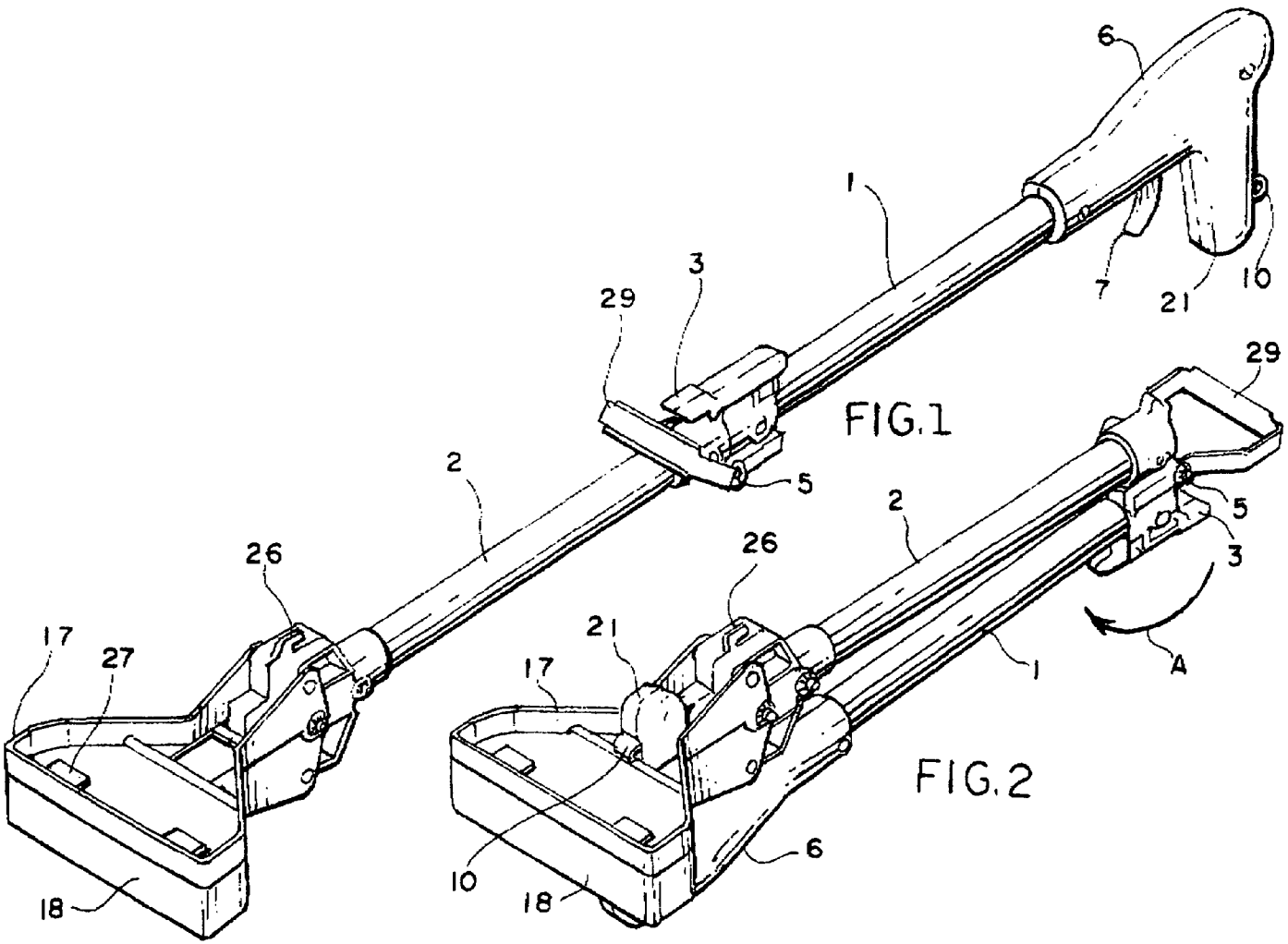
FIG. 1 is a perspective view of the full length of the animal waste handling device.
FIG. 2 shows the animal waste handling device of FIG. 1 in a reduced length.

FIG. 1 illustrates the inventive pickup device in its full or employable length. The handle consists of two parts 1 and 2 that are hinged together by way of a hinge shown at 5. The two halves 1 and 2 can be unlocked from each other by activating the catch 3. This catch is also shown in FIG. 2. This will unlock the two halves and the reduced length of the handle can be handled by a handle bar 29. The right end of the pickup device has a hand hold 6 thereon. On this hand hold there is shown a catch 10 which will lock the upper half 1 of the handle in a locked position once the handle is double folded. The catch 10 is located on a sliding housing which will be explained below. Also see FIG. 2. On the left side or the downside of the lower handle 2 there are located two clamp elements 17, an upper, and 18, a lower. Both clamp elements 17 and 18 form a clamp which is shown in a closed position on the downside of the lower handle 2 shown in both FIGS. 1 and 2. Also shown in both FIGS. 1 and 2 is a hook 26 which may be used for attaching an eyelet of a closing string 26 of a bag 24 shown and explained in FIG. 4.

Figure 3:
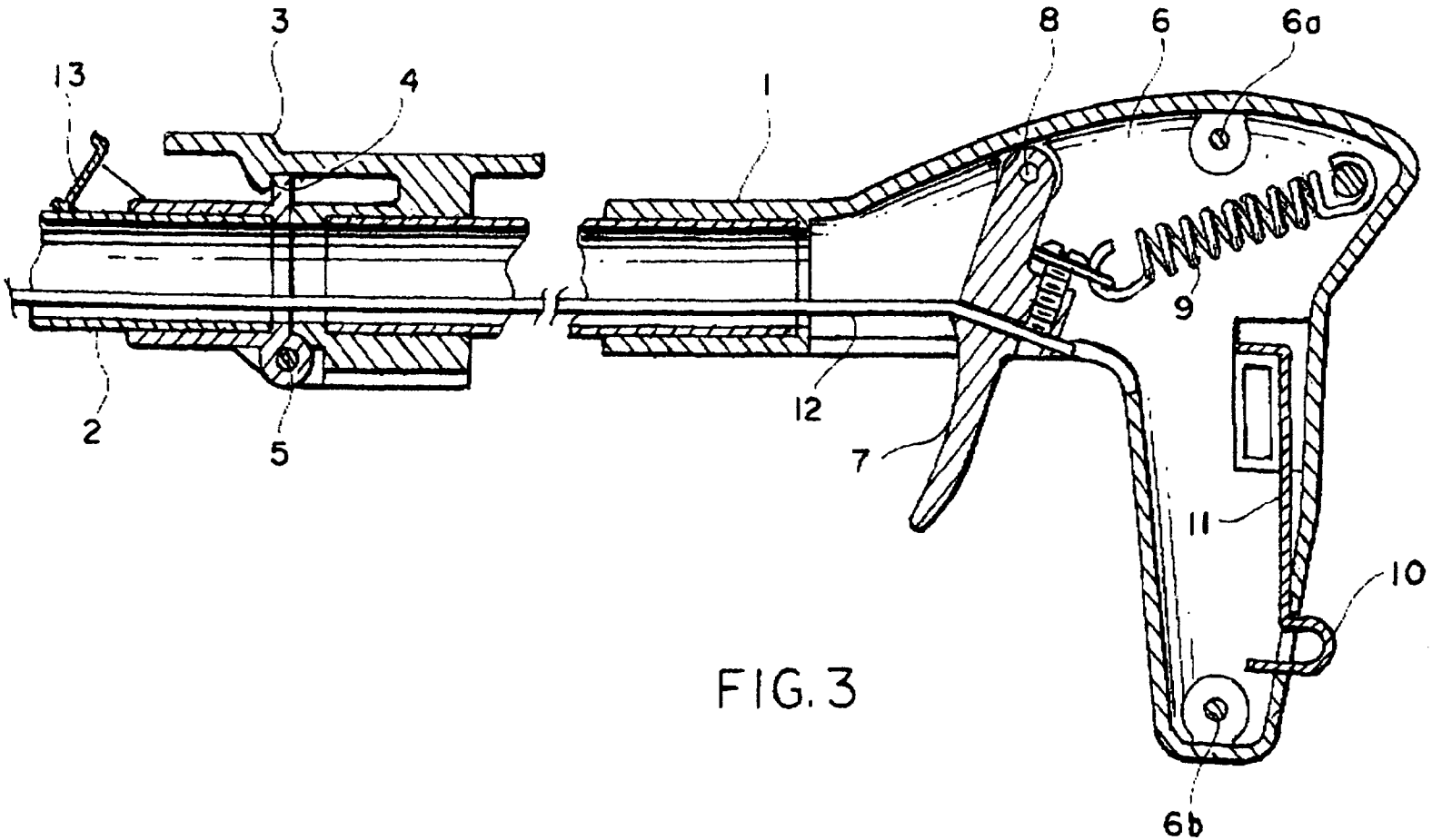
FIG. 3 illustrates the handle end of the animal waste handling device including the trigger and the cable activator.

FIG. 3 shows a cross section through the upper hand hold 6 consisting of two halves which are fastened together by way of the fasteners 6*a* and 6*b*. Also notice the catch 10 which has a backup spring 11 which biases the catch outwardly. The hand hold 6 also has a trigger 7 therein which may be pivoted around the pivot 8. The hand hold 6 also has a compression spring 9 which will return the trigger 7 to its original position once it is activated. The 7 has attached thereto a cable 12 which will activate both clamp elements 17 and 18 which will explained below. Clearly shown in this FIG. 2 there is an activating catch 3 which is hooked over a detent 4 to keep both the upper handle 1 and the lower handle 2 in a locked position when the device is in a use position. By merely lifting up on the activating catch 3, the two handles 1 and 2 may pivot around the pivot pin 5 and the two handles 1 and 2 may be folded over each other into a collapsed position as is shown in FIG. 2.

Figure 4:
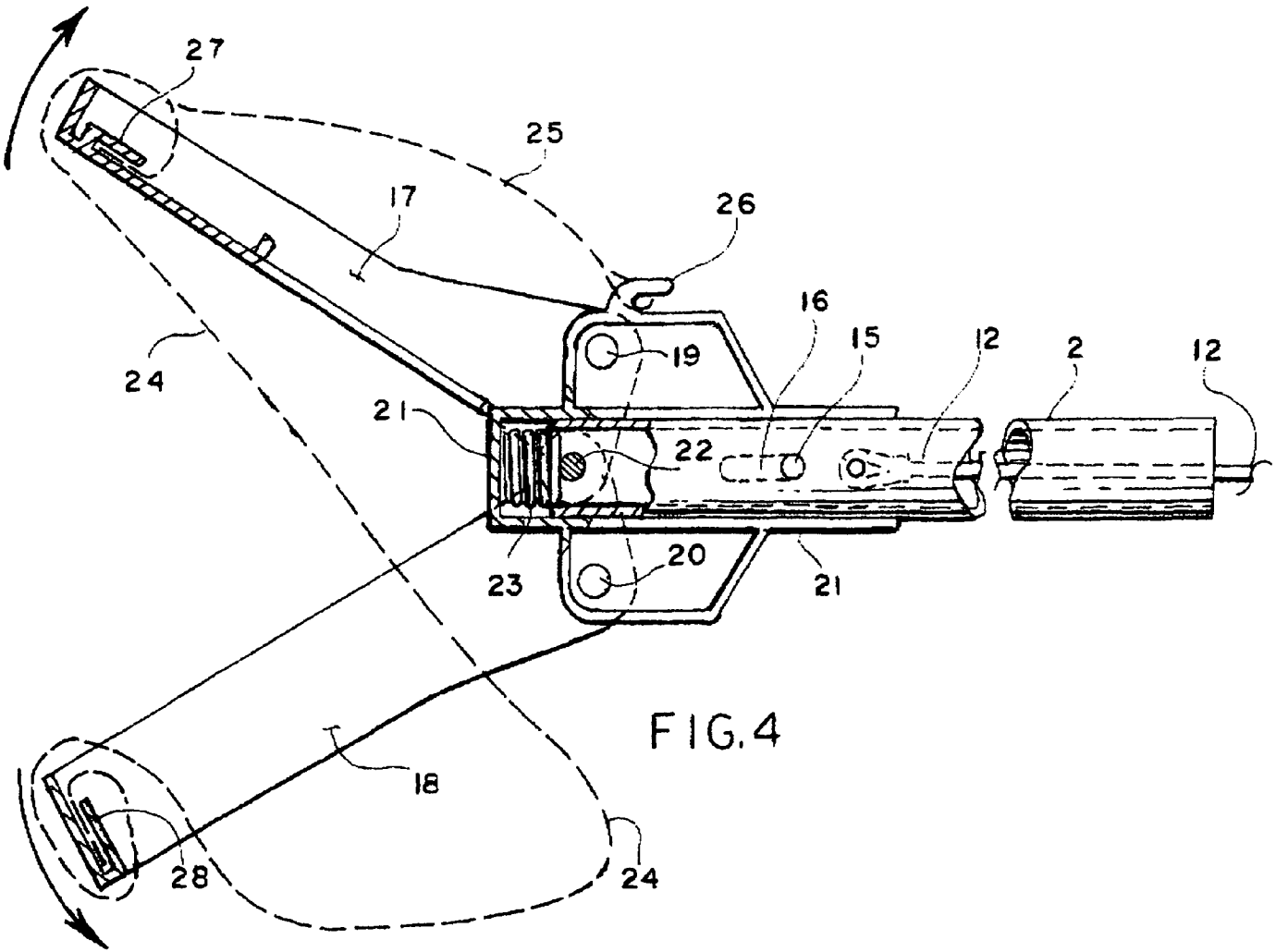
FIG. 4 shows the jaw end of the animal waste handling device in an open state.

FIG. 4 shows the clamp consisting of the two clamp elements 17 and 18 in an open position. This open position was obtained because the trigger 7 in FIG. 3 was activated whereby the cable 12, which is attached to a sliding housing 21 moved the sliding housing to the right in FIG. 4 against the bias of a compression spring 23. The two clamp dements 17 and 18 are attached to the sliding housing 21 by way of a common connector with the two clamp elements rotating around the pivot or connector 22. The two clamp elements 17 and 18 are each also connected to the sliding housing at pivot points 19 and 20, respectively. When the sliding housing 21 is moved to the right by way of the cable 1. The movement of the sliding housing 21 causes both clamp elements which are sliding with the housing 21 to rotate each around their respective pivot pins 19 and 20 to thereby assume an opened state as is shown in FIG. 4. Attached to the clamp elements 17 is a waste bag 24 which in an opened state attaches one side of the opening in the bag to the upper clamp element 17 at a catch 27, while the other side of the opening of the bag is attached to the clamp element at the catch 28 of the lower clamp element 18. When the clamp elements 17 and 18 are wide open as shown in FIG. 4, the clamp elements 17 and 18 together with the open bag may now be used to scrape up any waste on the ground. The opening of the bag also has attached thereto a closing string 25 which may be held in place and ready for use by a loop on the catch 26. It is readily available when the bag 24 is to be closed.

Figure 5:
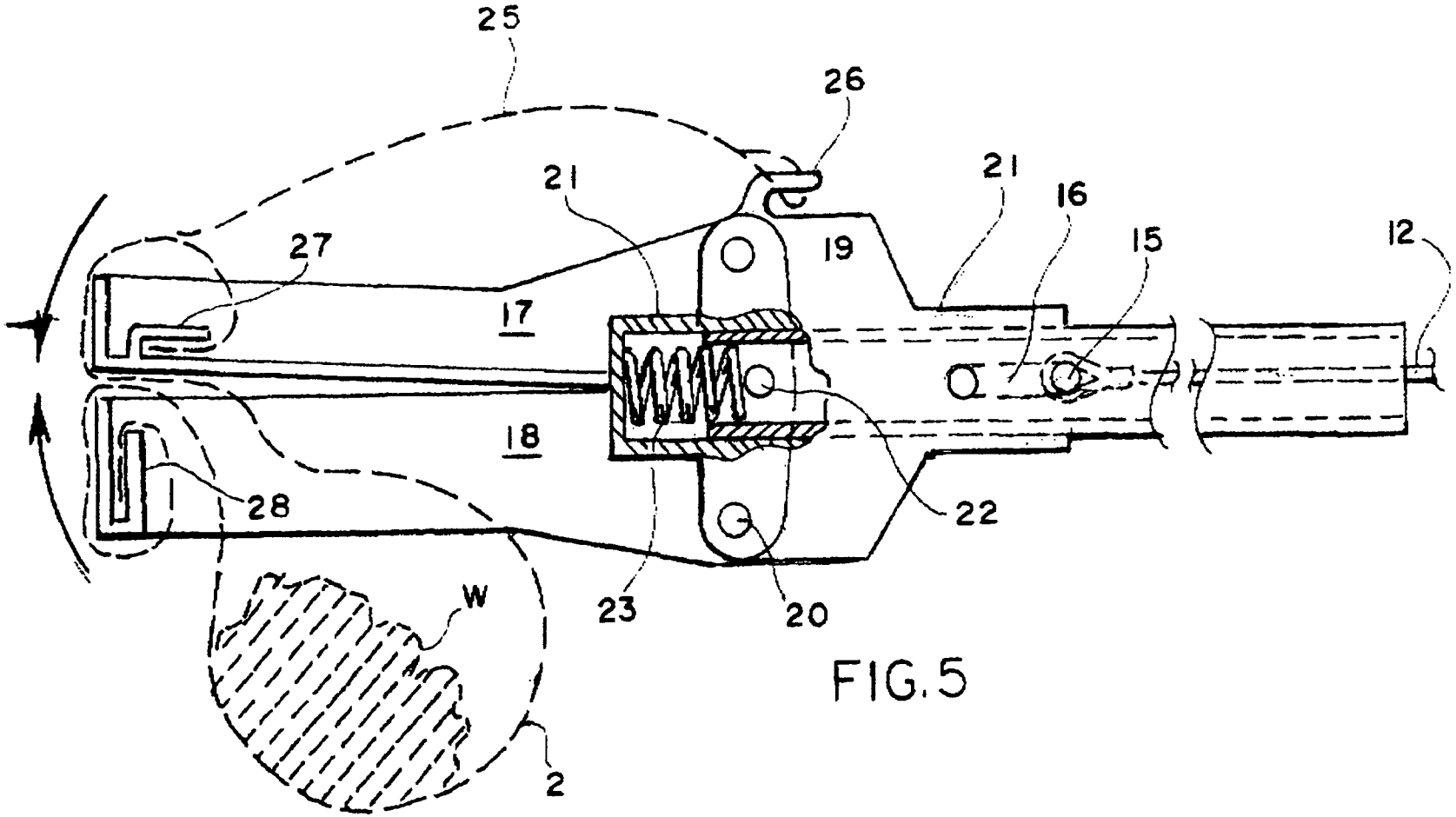
FIG. 5 shows the end of the animal waste handling device in a closed state including a bag contained therein.

FIG. 5 shows the clamp elements 17 and 18 in a closed position after the waste W has been picked and the clamp elements have been closed after the trigger 7 in FIG. 3 has been released and the compression spring in both FIGS. 4 and 5 has exerted its bias and moved the sliding housing 21 to the left and taking the clamp elements 17 and 18 along and causing them to close. The bag 24 together with the waste W therein may now be released from its catches 27 and 28 and the string 25 may now be used the tie up the opening in the bag and the bag may now be disposed of.

What I claim is:

1. An animal waste handling device comprising an elongated handle having a first handle segment, a second handle segment pivotally carried by said first handle segment, a flexible activating catch provided on a first one of said first handle segment and said second handle segment and a detent provided in said activating catch and adapted to detachably engage a second one of said first handle segment and said second handle segment; an upper handhold provided on said first handle segment and two movable clamp elements provided on said second handle segment, said handhold having a trigger therein which is movable against a bias of a spring, said trigger having attached thereto one end of a cable with the other end of said cable being attached to a sliding housing, said sliding housing being movable on an outside surface of said second handle segment of said elongated handle and having means thereon to open or close said movable clamp elements, whereby, when said trigger is manually activated said cable will move said sliding housing to open or close said clamp elements.

2. The animal waste handling device of claim 1, wherein said trigger is moved against the bias of a spring.

3. The animal waste handling device of claim 1, wherein said sliding housing is moved against a bias of a spring.

4. The animal waste handling device of claim 1, wherein said elongated handle has means thereon to be folded in half and being locked in a doubled over position.

5. The animal waste handling devices of claim 4 including a hand hold on a lower of said elongated handle once said elongated handle is folded in half.

6. The animal waste handling device of claim 4 including a biased catch on said upper hand hold, said catch being caught in a detent on said sliding housing once said elongated handle is folded over.

7. The animal waste handling device of claim 1, wherein said clamp elements each have catches thereon to receive an opening of a waste bag.

8. The animal waste handling device of claim 7 including a hook on said sliding housing to receive an eyelet of a string constituting means for damping said bag once said elongated handle is folded in half.

9. An animal waste handling device comprising:

an elongated handle having a first handle segment, a second handle segment pivotally carried by said first handle segment, a flexible activating catch provided on a first one of said first handle segment and said second handle segment and a detent provided in said activating catch and adapted to detachably engage a second one of said first handle segment and said second handle segment;

an upper handhold provided on said first handle segment and two movable clamp elements provided on said second handle segment, said handhold having a trigger therein which is movable against a bias of a spring, said trigger having attached thereto one end of a cable with the other end of said cable being in communication with said movable clamp elements, whereby, when said trigger is manually activated said cable will move said sliding housing to open or close said clamp elements.

10. The animal waste handling device of claim 9, wherein said trigger is moved against the bias of a spring.

11. The animal waste handling device of claim 9, wherein said opening or closing of said clamp elements occurs against a bias of a spring.

12. The animal waste handling device of claim 9, wherein said elongated handle has means thereon to be folded in half and being locked in a doubled over position.

13. The animal waste handling devices of claim 12 including a hand hold on a lower of said elongated handle once said elongated handle is folded in half.

14. The animal waste handling device of claim 12 including a biased catch on said upper hand hold, said catch being caught in a detent on said sliding housing once said elongated handle is folded over.

15. The animal waste handling device of claim 9, wherein said clamp elements each have catches thereon to receive an opening of a waste bag.

16. The animal waste handling device of claim 15 including a hook on a sliding housing to receive an eyelet of a string constituting means for damping said bag once said elongated handle is folded in half.

17. An animal waste handling device comprising:

an elongated handle having a first handle segment, a second handle segment pivotally carried by said first handle segment, a flexible activating catch provided on a first one of said first handle segment and said second handle segment and a detent provided in said activating catch and adapted to detachably engage a second one of said first handle segment and said second handle segment;

an upper handhold provided on said first handle segment and two movable clamp elements provided on said second handle segment, said handhold having a trigger therein which is movable against a bias of a spring, said trigger having attached thereto one end of a cable with the other end of said cable being in communication with said movable clamp elements, whereby, when said trigger is manually activated said cable will move said sliding housing to open or close said clamp elements; and a waste bag being assembled to said clamp elements, providing a bag opening between the pair of clamp elements.

18. The animal waste handling device of claim 17, wherein said clamp elements each have catches thereon to receive an opening of a waste bag.

19. The animal waste handling device of claim 17 including a hook on a sliding housing to receive an eyelet of a string constituting means for damping said bag once said elongated handle is folded in half.

* * * * *